US012345261B2

(12) United States Patent
North

(10) Patent No.: US 12,345,261 B2
(45) Date of Patent: Jul. 1, 2025

(54) STATOR FOR A VACUUM PUMP

(71) Applicant: Edwards Limited, Burgess Hill (GB)

(72) Inventor: Michael Henry North, Burgess Hill (GB)

(73) Assignee: Edwards Limited, Burgess Hill (GB)

( * ) Notice: Subject to any disclaimer, the term of this patent is extended or adjusted under 35 U.S.C. 154(b) by 50 days.

(21) Appl. No.: 18/557,782

(22) PCT Filed: Apr. 29, 2022

(86) PCT No.: PCT/GB2022/051092
§ 371 (c)(1),
(2) Date: Oct. 27, 2023

(87) PCT Pub. No.: WO2022/229652
PCT Pub. Date: Nov. 3, 2022

(65) Prior Publication Data

US 2024/0218877 A1 Jul. 4, 2024

(30) Foreign Application Priority Data

Apr. 30, 2021 (GB) ..... 2106234

(51) Int. Cl.
*F04C 18/12* (2006.01)
*F04C 25/02* (2006.01)
(Continued)

(52) U.S. Cl.
CPC ..... *F04C 25/02* (2013.01); *F04C 18/126* (2013.01); *F04C 28/24* (2013.01); *F04C 28/26* (2013.01);
(Continued)

(58) Field of Classification Search
CPC ..... F04C 18/086; F04C 18/12; F04C 18/126; F04C 23/008; F04C 25/02; F04C 28/24;
(Continued)

(56) References Cited

U.S. PATENT DOCUMENTS 5,040,949 A 8/1991 Crinquette et al.
9,297,384 B2 3/2016 Stones et al.
(Continued)

FOREIGN PATENT DOCUMENTS

CN 108775286 A 11/2018
CN 213684513 U 7/2021
(Continued)

OTHER PUBLICATIONS

Japanese Notification of Reason for Rejection dated Nov. 14, 2024 for corresponding Japanese application Serial No. 2023-566789, 8 pages.
(Continued)

*Primary Examiner* — Theresa Trieu
(74) *Attorney, Agent, or Firm* — Theodore M. Magee; Westman, Champlin & Koehler, P.A.

(57) ABSTRACT

At least a part of a stator for a vacuum pump, comprising: a plurality of walls defining therebetween at least a part of a pumping chamber; a channel formed within one or more of the walls of the plurality of walls, the channel comprising a first opening at a first end of the channel and a second opening at a second end of the channel, the first opening being an opening in an internal surface of the one or more of the walls and being in fluid communication with the pumping chamber; and a pressure relief valve disposed within the channel.

7 Claims, 6 Drawing Sheets

(51) Int. Cl.

| | |
|---|---|
| ***F04C 28/24*** | (2006.01) |
| ***F04C 28/26*** | (2006.01) |
| ***F04C 29/04*** | (2006.01) |

(52) U.S. Cl.
CPC ..... *F04C 29/04* (2013.01); *F04C 2240/10* (2013.01); *F04C 2240/30* (2013.01)

(58) Field of Classification Search
CPC ..... F04C 28/26; F04C 28/28; F04C 27/008; F04C 29/04; F04C 2220/10; F04C 2220/30; F04C 2240/10; F04C 2240/30; F04C 2280/00; F04C 2280/02; F01C 19/00
See application file for complete search history.

(56) References Cited

U.S. PATENT DOCUMENTS

| | | | | |
|---|---|---|---|---|
| 2003/0035738 | A1 | 2/2003 | Kim | |
| 2003/0202887 | A1 | 10/2003 | Apostolides et al. | |
| 2005/0123415 | A1* | 6/2005 | Hoshino ..... | F01C 21/10 417/369 |
| 2011/0129374 | A1 | 6/2011 | Kamecke et al. | |
| 2012/0039737 | A1 | 2/2012 | Birch et al. | |
| 2015/0078927 | A1* | 3/2015 | Forni ..... | F04B 25/00 417/244 |
| 2017/0082108 | A1 | 3/2017 | Tsai et al. | |
| 2020/0124050 | A1 | 4/2020 | Turner et al. | |

FOREIGN PATENT DOCUMENTS

| | | | |
|---|---|---|---|
| EP | 0811766 | A2 | 12/1997 |
| EP | 1265338 | A2 | 12/2002 |
| EP | 1340916 | A2 | 9/2003 |
| EP | 3808982 | A1 | 4/2021 |
| GB | 2520140 | A | 5/2015 |
| JP | 2021063503 | A | 4/2021 |
| WO | 2020229163 | A1 | 11/2020 |
| WO | 2022229650 | A1 | 11/2022 |

OTHER PUBLICATIONS

British Examination Report dated Oct. 4, 2021 and Search Report dated Oct. 1, 2021 for corresponding British Application No. GB2106233.6, 7 pages.

PCT Notification of Transmittal of the International Search Report and the Written Opinion of the International Searching Authority, or the Declaration and PCT Search Report dated Oct. 7, 2022 for corresponding PCT application Serial No. PCT/GB2022/051090, 17 pages.

British Examination Report dated Oct. 4, 2021 and Search Report dated Oct. 1, 2021 for corresponding British Application No. GB2106234.4, 7 pages.

PCT Notification of Transmittal of the International Search Report and the Written Opinion of the International Searching Authority, or the Declaration and PCT Search Report dated Jan. 16, 2023 corresponding PCT application Serial No. PCT/GB2022/051092, 21 pages.

* cited by examiner

STATOR FOR A VACUUM PUMP

CROSS-REFERENCE OF RELATED APPLICATION

This application is a Section 371 National Stage Application of International Application No. PCT/GB2022/051092, filed Apr. 29, 2022, and published as WO 2022/229652A2 on Nov. 3, 2022, the content of which is hereby incorporated by reference in its entirety and which claims priority of British Application No. 2106234.4, filed Apr. 30, 2021.

FIELD

The present invention relates to stators for vacuum pumps and parts thereof.

BACKGROUND

Vacuum pumps are used in various technical processes to pump gases out of process chambers, thereby to create low-pressure conditions for the respective processes.

The discussion above is merely provided for general background information and is not intended to be used as an aid in determining the scope of the claimed subject matter. The claimed subject matter is not limited to implementations that solve any or all disadvantages noted in the background.

SUMMARY

The present inventors have realised that, in use, a pressure differential within the pumping chamber of a vacuum pump may reach or exceed levels that may damage components of the vacuum pump. For example, the pressure differential across the rotors, between suction and exhaust sides of the pumping chamber, may be high enough to damage the rotors, shafts and/or bearings of the pump. Thus, a pressure relief system including a pressure relief valve for the pumping chamber is desirable. The present inventors have realised that locating a pressure relief valve in a relatively cool part of the pump, such as a headplate, risks the pressure relief being contaminated or impaired by condensate from a pumped fluid. The present inventors have realised that by locating the pressure relief valve in a relative hot portion of the pump, such as a wall of the stator, the amount of condensate may be reduced.

In an aspect, there is provided at least a part of a stator for a vacuum pump, the at least a part of a stator having an integrated or integral pressure relief system comprising a pressure relief valve.

In an aspect, there is provided at least a part of a stator for a vacuum pump, comprising: a plurality of walls defining therebetween at least a part of a pumping chamber; a channel formed within one or more of the walls of the plurality of walls, the channel comprising a first opening at a first end of the channel and a second opening at a second end of the channel, the first opening being an opening in an internal surface of the one or more of the walls and is in fluid communication with the pumping chamber; and a pressure relief valve disposed within the channel.

The first opening may be located at an exhaust side of the pumping chamber.

The second opening may be an opening in the internal surface of one or more of the walls and is in fluid communication with the pumping chamber. The second opening may be located at a suction side of the pumping chamber.

The pressure relief valve may be located in a housing that is removable from the at least a part of the stator via an aperture in an external surface of the at least a part of the stator.

The plurality of walls may comprise an end wall, and one or more sidewalls extending from the end wall. The end wall and the one or more sidewalls may define an internal cavity. The channel may be formed in the end wall. The first opening may be formed in an internal surface of the end wall. The second opening may be formed in an internal surface of the end wall. The end wall and the one or more sidewalls may be a unitary item. The end wall may comprise one or more through bores, each of the one or more through bores being for receiving a respective rotor shaft. The at least a part of a stator for a vacuum pump may further comprise an inlet channel formed through a sidewall of the one or more sidewalls for allowing a fluid to flow from an outside of the at least a part of the stator into the internal cavity. The end wall may comprise an external surface, the external surface of the end wall comprising one or more recesses. The one or more recesses may be selected from the group of recess consisting of a loop-shaped groove for receiving an O-ring and a recess configured to receive a thermally insulative spacer. The at least a part of a stator may further comprise: an O-ring and/or one or more thermally insulative spacers disposed within the one or more recesses; and a headplate for supporting one or more rotor shafts, the headplate being disposed facing the external surface of the end wall and against the O-ring and/or the one or more thermally insulative spacers such that the headplate is spaced apart from the external surface of the end wall.

In a further aspect, there is provided a vacuum pump comprising: a stator comprising at least a part of a stator according to any preceding aspect; one or more rotor shafts extending through a pumping chamber of the stator; and one or more rotors, each rotor being mounted on a respective one of the rotor shafts.

The Summary is provided to introduce a selection of concepts in a simplified form that are further described in the Detailed Description. This summary is not intended to identify key features or essential features of the claimed subject matter, nor is it intended to be used as an aid in determining the scope of the claimed subject matter.

DETAILED DESCRIPTION

It will be appreciated that relative terms such as above and below, horizontal and vertical, top and bottom, front and back, and so on, are used herein merely for ease of reference to the Figures, and these terms are not limiting as such, and any two differing directions or positions and so on may be implemented rather than truly above and below, horizontal and vertical, top and bottom, and so on.

Figure 1:
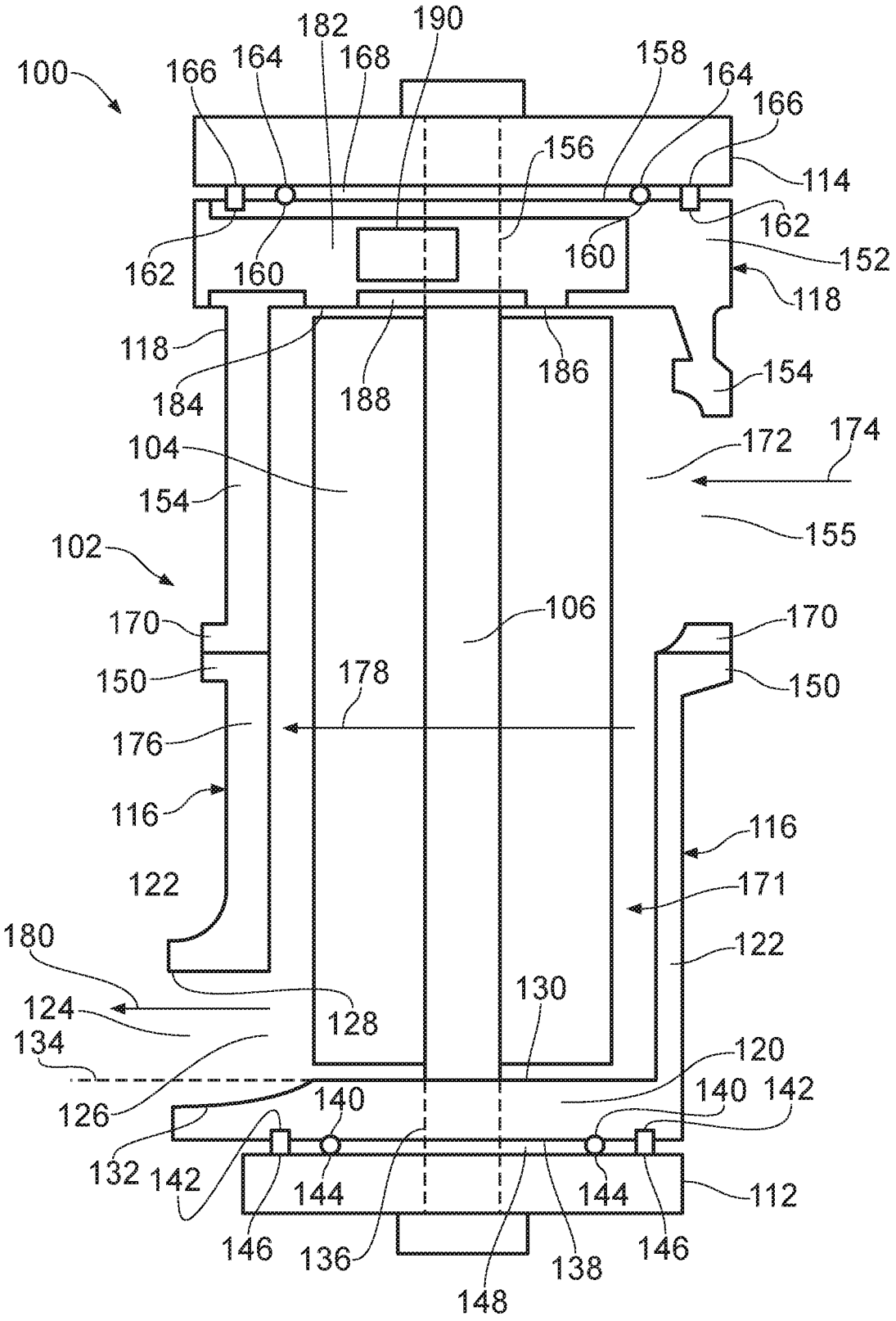
FIG. 1 is a schematic illustration (not to scale) of a side view cross section of a vacuum pump.

FIG. 1 is a schematic illustration (not to scale) of a side view cross section of an embodiment of a vacuum pump 100.

Figure 2:
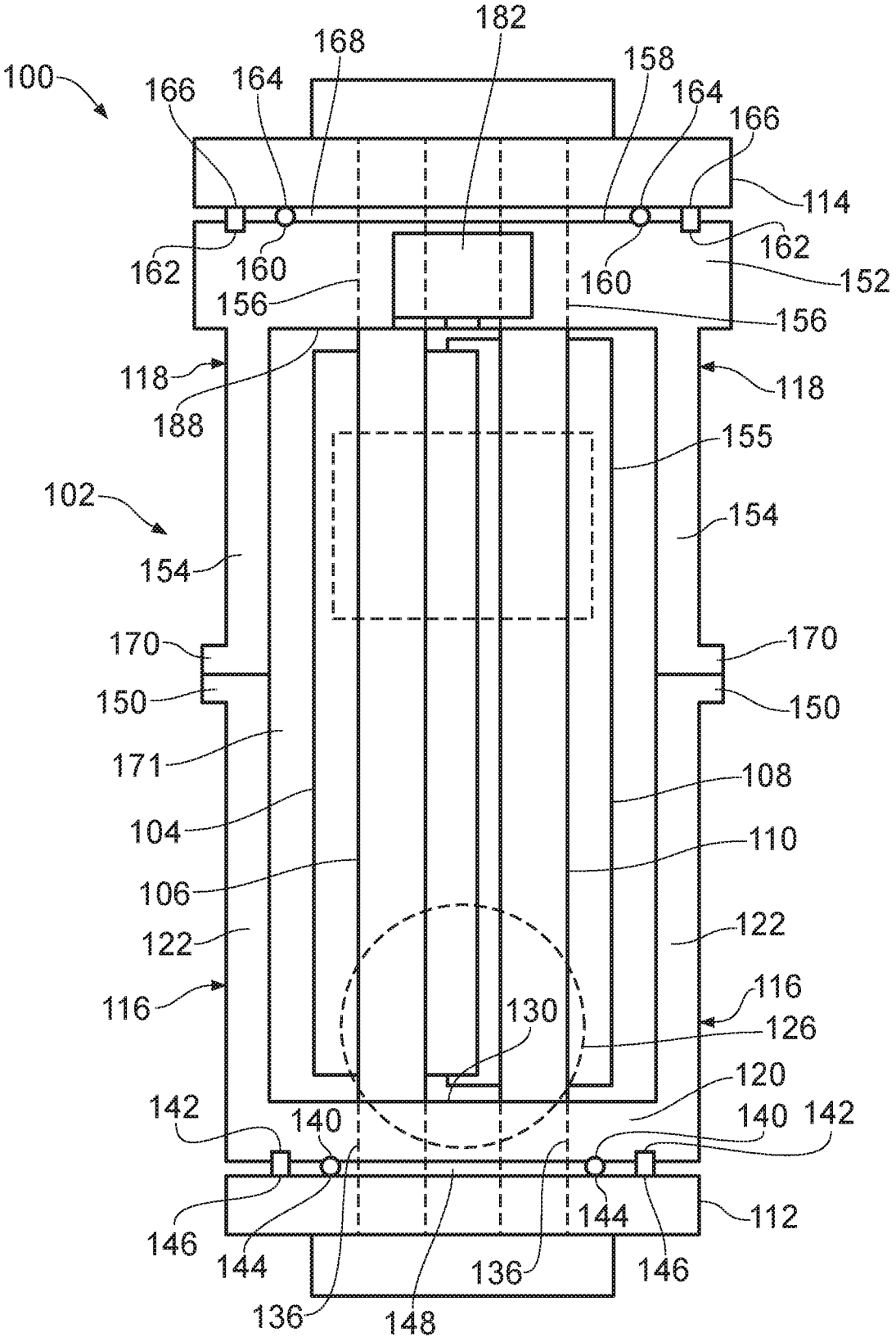
FIG. 2 is a schematic illustration (not to scale) of a front view cross section of the vacuum pump.

FIG. 2 is a schematic illustration (not to scale) of a front view cross section of the vacuum pump 100.

The vacuum pump 100 is a vertically oriented Roots-type vacuum pump.

The vacuum pump 100 comprises a stator 102, a first rotor 104 mounted to a first rotor shaft 106, a second rotor 108 mounted to a second rotor shaft 110, a first headplate 112, and a second headplate 114.

Figure 3:
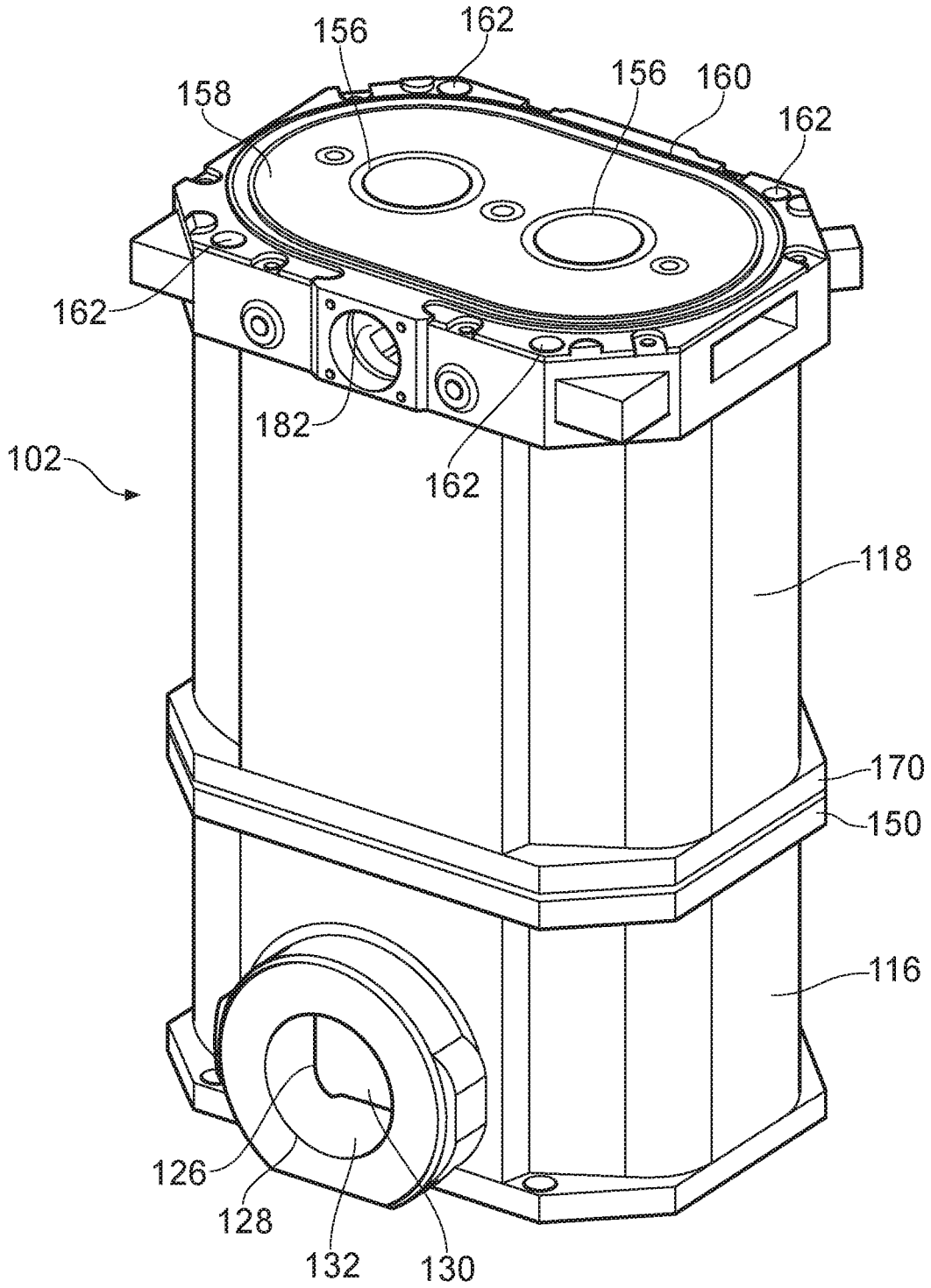
FIG. 3 is a schematic illustration (not to scale) showing a perspective view of a stator of the vacuum pump.
Figure 4:
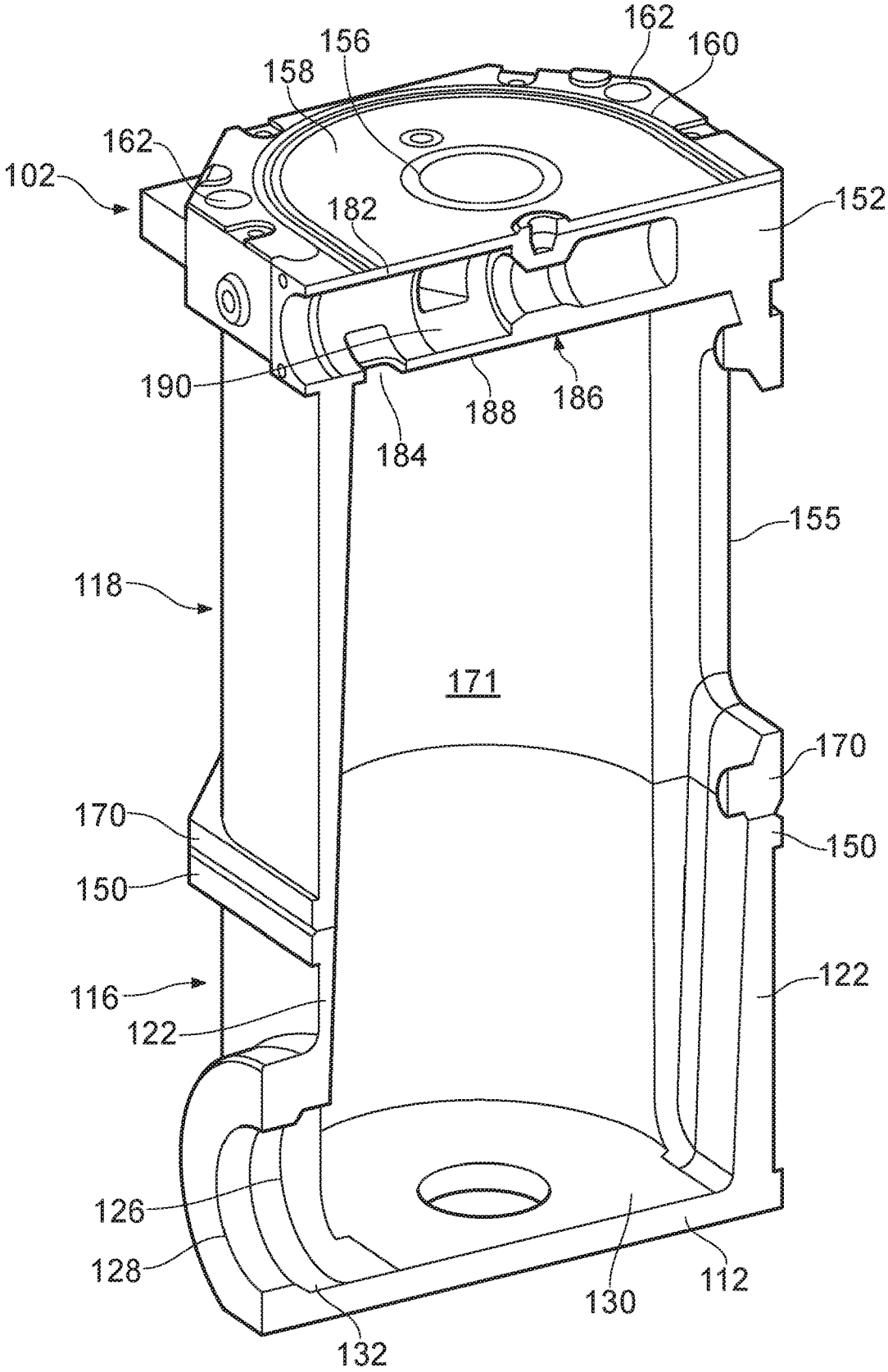
FIG. 4 is a schematic illustration (not to scale) showing a perspective cross section view of the stator.

The stator 102 comprises two parts, namely a first stator part 116 and a second stator part 118. Further views of the stator 102 are provided in FIGS. 3 and 4. FIG. 3 is a schematic illustration (not to scale) showing a perspective view of the stator 102. FIG. 4 is a schematic illustration (not to scale) showing a perspective cross section view of the stator 102.

The first stator part 116 and the second stator part 118 may be considered to be bucket stators that attach together to form the stator 102.

The first stator part 116 comprises a first wall 120 and one or more first sidewalls 122 extending from the first wall 120. The first wall 120 may be considered to be a bottom wall or a first end wall of the stator 102. The one or more first sidewalls 122 extend upwards from the first wall 120. The first wall 120 and the one or more first sidewalls 122 define an internal cavity. The first wall 120 and the one or more first sidewalls 122 may be a single, unitary item.

The first stator part 116 further comprises an outlet channel 124. The outlet channel 124 is a gas outlet of the stator 102. The outlet channel 124 is formed through one or more of the first sidewalls 122. The outlet channel 124 is a channel between a first opening 126 and a second opening 128. The first opening 126 is at an internal surface of the one or more sidewalls 122. The second opening 128 may be at an external surface of the one or more sidewalls 122, opposite to the in internal surface of the one or more sidewalls 122. Preferably, the outlet channel 124 slopes downwards from the first opening 126 to the second opening 128.

An internal surface 130 of the first wall 120 is contiguous with the first opening 126 of the outlet channel 124. Preferably, a lowest point of the internal surface 130 of the first wall 120 is contiguous with the first opening 126. Preferably, the internal surface 130 of the first wall 120 slopes downwards towards the first opening 126. Nevertheless, in some embodiments, the internal surface 130 may be substantially flat.

The internal surface 130 of the first wall 120 may be considered to abut, share a boundary with, join, be connected to, or be coincident with the first opening 126. When viewed from the side, as in FIG. 1, a lowermost surface 132 of the outlet channel 124 is substantially flush with, or more preferably below a level 134 of the internal surface 130 of the first wall 120. Also, when viewed from the front, as in FIG. 2, the internal surface 130 of the first wall 120 is coincident with a perimeter of the first opening 126, or more preferably lies within an area bounded by the perimeter of the first opening 126.

In this embodiment, the first wall 120 comprises two through bores 136. Each through bore 136 receives a respective one of the first rotor shaft 106 and the second rotor shaft 110. In other words, the first and second rotor shafts 106, 110 pass through the first wall 120 via respective through bores 136. The first and second rotor shafts 106, 110 may be sealed against the first wall 120 (i.e., the walls of the through bores 136) by any appropriate sealing means such as lip seals or labyrinth seals.

Figure 5:
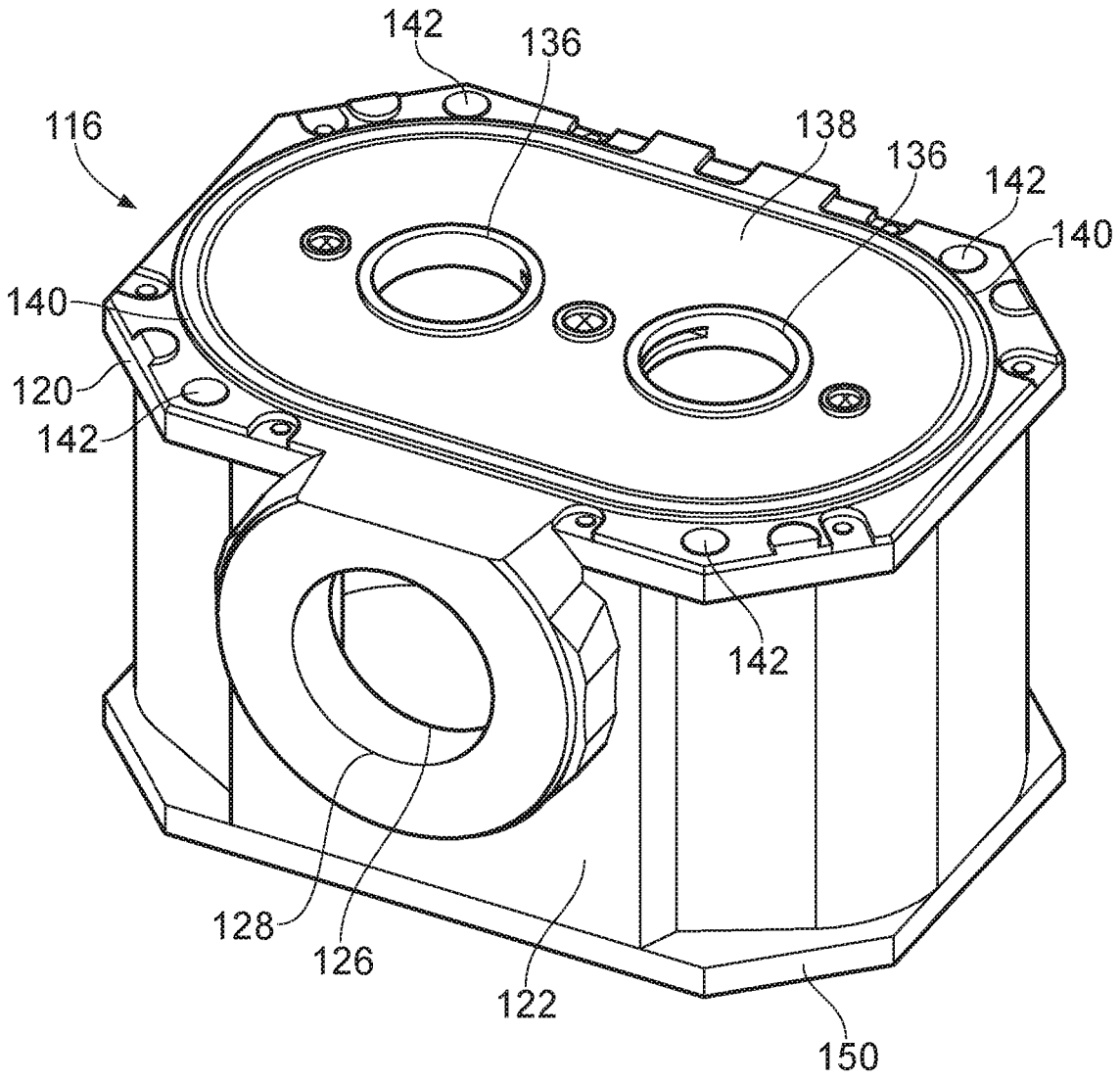
FIG. 5, which is a schematic illustration (not to scale) of a perspective view of a first part of the stator.

In this embodiment, an external surface 138 of the first wall 120, which is opposite to the internal surface 130 of the first wall 120, comprises a plurality of recesses. The external surface 138 of the first wall 120 may be more clearly seen in FIG. 5, which is a schematic illustration (not to scale) of a perspective view of the inverted first stator part 116.

More specifically, in this embodiment, the external surface 138 of the first wall 120 comprises a loop-shaped recess or groove 140. The loop-shaped groove 140 surrounds the through bores 136. The loop-shaped groove 140 may be located proximate to a peripheral edge of the external surface 138.

In this embodiment, the external surface 138 of the first wall 120 comprises a plurality of recesses 142, which in this embodiment are substantially cylindrical in shape. In this embodiment, the recesses 142 are disposed between the loop-shaped groove 140 and the edge of the external surface 138.

Referring back to FIGS. 1 and 2, in this embodiment a first O-ring 144 is disposed in the loop-shaped groove 140 of the external surface 138 of the first wall 120. The first O-ring 144 may be made of any appropriate material, for example polytetrafluoroethylene (PTFE). Preferably, the first O-ring 144 is made of a thermally insulative material. Also, in this embodiment, a plurality of first spacers 146 are disposed, respectively, in the plurality of recesses 142. The first spacers 146 may be substantially cylindrical in shape. In this embodiment, the first spacers 146 are made of a thermally insulative material, such as a ceramic material.

The first headplate 112 is positioned facing or opposing the external surface 138 of the first wall 120. The first headplate 112 is disposed against the first O-ring 144 and the first spacers 146. The first O-ring 144 and/or the first spacers 146 maintain the first headplate 112 spaced apart from the external surface 138 of the first wall 120. Thus, a gap 148 (e.g. an air gap) is provided between the stator 102 and the first headplate 112. The first O-ring 144 forms a seal between the stator 102 and the first headplate 112, i.e. between the external surface 138 of the first wall 120 and the facing surface of the first headplate 112.

The first headplate 112 is configured to support the first and second rotor shafts 106, 110 at the bottom ends of those rotor shafts 106, 110. The first headplate may be a conventional headplate. The first headplate 112 may comprise bearings and/or seal systems for supporting the rotor shafts 106, 110.

In this embodiment, the one or more first sidewalls 122 comprises a first flange 150 at the ends of the first sidewalls 122 opposite to the first wall 120.

The second stator part 118 comprises a second wall 152 and one or more second sidewalls 154 extending from the second wall 152. The second wall 152 may be considered to be a top wall or a second end wall of the stator 102. The one or more second sidewalls 154 extend downwards from the second wall 152. The second wall 152 and the one or more second sidewalls 154 define an internal cavity. The second wall 152 and the one or more second sidewalls 154 may be a single, unitary item.

The second stator part 118 further comprises an inlet channel 155. The inlet channel 155 is a gas inlet of the stator 102. The inlet channel 155 is formed through one or more of the second sidewalls 154.

In this embodiment, the second wall 152 comprises two through bores 156. Each through bore 156 receives a respective one or the first rotor shaft 106 and the second rotor shaft 110. In other words, the first and second rotor shafts 106, 110 pass through the second wall 152 via respective through bores 156. The first and second rotor shafts 106, 110 may be sealed against the second wall 152 (i.e., the walls of the through bores 156) by any appropriate sealing means such as lip seals or labyrinth seals.

Figure 6:
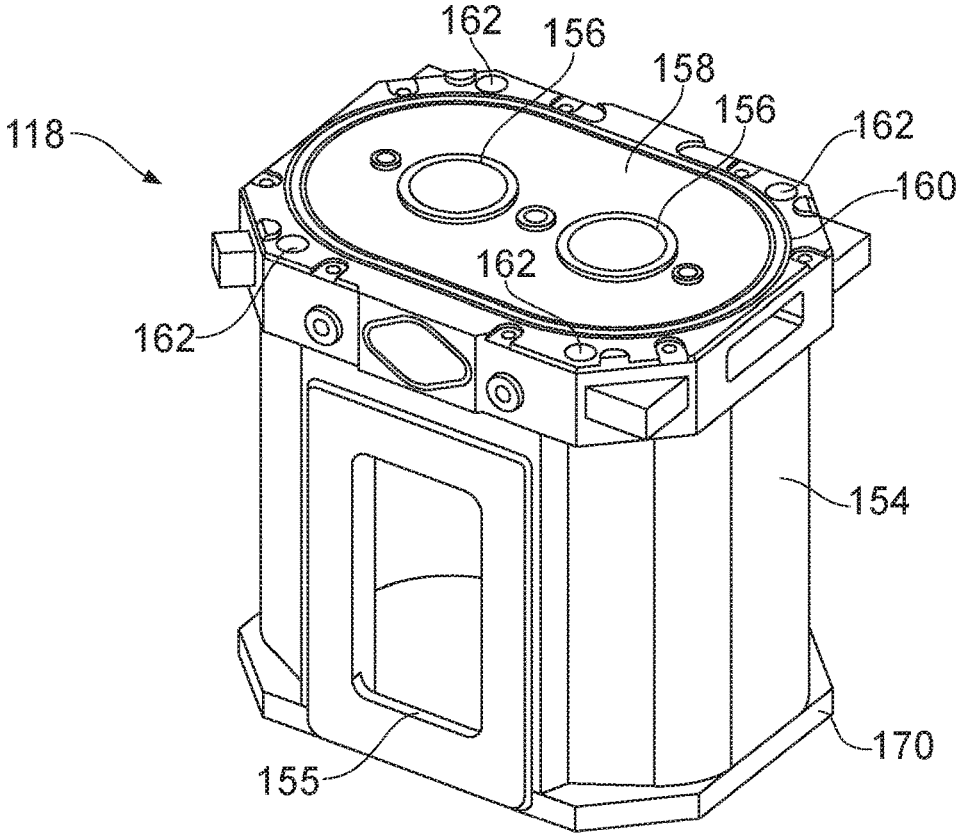
FIG. 6 is a schematic illustration (not to scale) of a perspective view of a second part of the stator.
Figure 7:
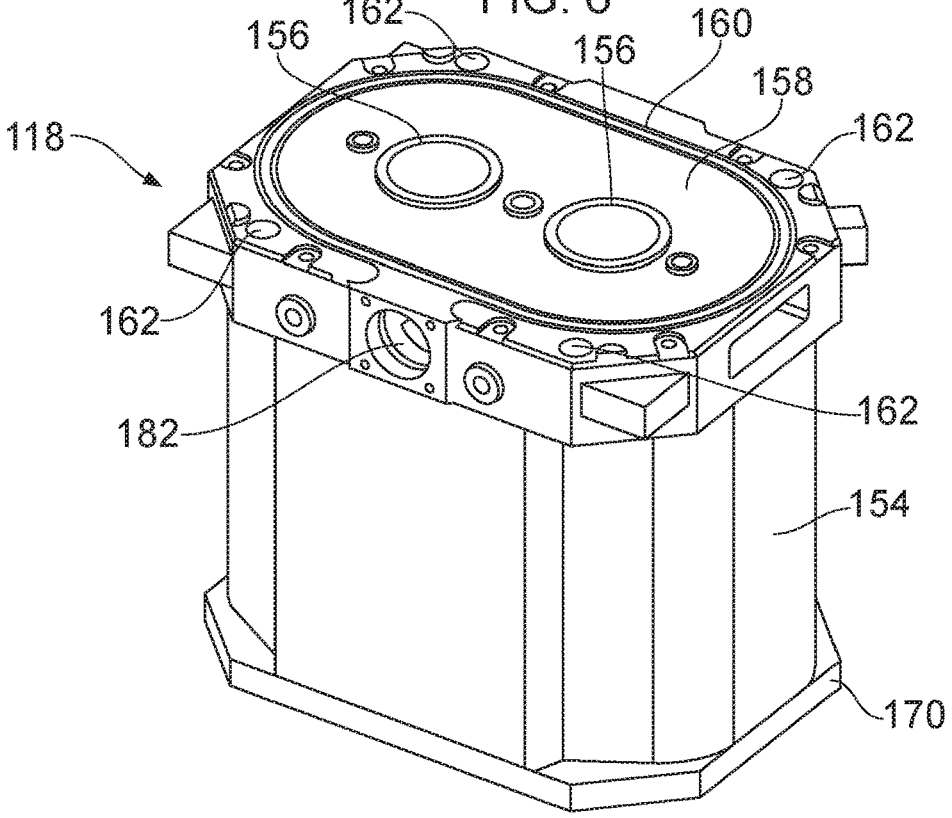
FIG. 7 is a schematic illustration (not to scale) of a perspective view of the second part of the stator.

In this embodiment, an external surface 158 of the second wall 152 comprises a plurality of recesses. The external surface 158 of the second wall 152 may be more clearly seen in FIGS. 6 and 7, which are schematic illustrations (not to scale) of perspective views of the second stator part 118.

More specifically, in this embodiment, the external surface 158 of the second wall 152 comprises a loop-shaped recess or groove 160. The loop-shaped groove 160 surrounds the through bores 156. The loop-shaped groove 160 may be located proximate to a peripheral edge of the external surface 158.

In this embodiment, the external surface 158 of the second wall 152 comprises a plurality of recesses 162, which in this embodiment are substantially cylindrical in shape. In this embodiment, the recesses 162 are disposed between the loop-shaped groove 160 and the edge of the external surface 158.

Referring back to FIGS. 1 and 2, in this embodiment a second O-ring 164 is disposed in the loop-shaped groove 160 of the external surface 158 of the second wall 152. The second O-ring 164 may be made of any appropriate material, for example polytetrafluoroethylene (PTFE). Preferably, the second O-ring 164 is made of a thermally insulative material. Also, in this embodiment, a plurality of second spacers 166 are disposed, respectively, in the plurality of recesses 162. The second spacers 166 may be substantially cylindrical in shape. In this embodiment, the second spacers 166 are made of a thermally insulative material, such as a ceramic material.

The second headplate 114 is positioned facing or opposing the external surface 158 of the second wall 152. The second headplate 114 is disposed against the second O-ring 164 and the second spacers 166. The second O-ring 164 and/or the second spacers 166 maintain the second headplate 114 spaced apart from the external surface 158 of the second wall 152. Thus, a gap 168 (e.g. an air gap) is provided between the stator 102 and the second headplate 114. The second O-ring 164 forms a seal between the stator 102 and the second headplate 114, i.e. between the external surface 158 of the second wall 152 and the facing surface of the second headplate 114.

The second headplate 114 is configured to support the first and second rotor shafts 106, 110 at the top ends of those rotor shafts 106, 110. The second headplate 114 may be a conventional headplate. The second headplate 114 may comprise bearings and/or seal systems for supporting the rotor shafts 106, 110.

In this embodiment, the one or more second sidewalls 154 comprise a second flange 170 at the ends of the second sidewalls 154 opposite to the second wall 152.

In its assembled configuration, as shown in FIGS. 1 to 4, the second stator part 118 is positioned on the first stator part 116 such that the second flange 170 contacts with the first flange 150. The first stator part 116 and the second stator part 118 are attached together by a plurality of fasteners (not shown) fastened through the first and second flanges 150, 170.

The walls of the first stator part 116 and the second stator part 118, i.e. the first wall 120, the first sidewalls 122, the second wall 152 and the second sidewalls 154 define an internal cavity or chamber 171. The chamber 171 may be referred to as the stator bore. This chamber 171 is the pumping chamber of the vacuum pump 100. The rotors 104, 108 are located within the chamber 171.

In operation, one or more motors (not shown) drive the rotor shafts 106, 110, thereby causing the rotors 104, 108 to rotate about parallel axes in the chamber 171. This rotation of the rotors 104, 108 draws gas into a suction side 172 of the chamber 171, via the inlet 155, as indicated in FIG. 1 by an arrow and the reference numeral 174. Continued rotation of the rotors 104, 108 subsequently moves the gas from the suction side 172 of the chamber 171 to an exhaust side 176 of the chamber 171, as indicated in FIG. 1 by an arrow and the reference numeral 178. Continued rotation of the rotors 104, 108 subsequently moves the gas from the exhaust side 176 of the chamber 171 out of the outlet 124, as indicated in FIG. 1 by an arrow and the reference numeral 180.

Thus, the rotors 104, 108 may be considered to divide the chamber 171 into the suction side 172 (at which the inlet 155 is located) and the exhaust side 176 (at which the outlet 124 is located).

The fluid (e.g. gas) pumped by the vacuum pump 100 may contain or carry with it liquid and/or particulate matter, such as dust. Furthermore, the pumped fluid may condense on surfaces within the chamber 171. This liquid and/or particulate matter tends to fall due to gravity to the bottom of the pumping chamber 171, and may collect on the internal surface 130 of the first wall. Advantageously, the internal surface 130 of the first wall 120 being contiguous with the first opening 126 of the outlet channel 124 tends to provide that the liquid and/or particulate matter flows or travels out of the pumping chamber via the outlet 124. This draining of liquid and/or removal of particulate matter from the chamber 171 tends to be further facilitated by the lowest point of the internal surface 130 being contiguous with the first opening 126 and/or the internal surface 130 sloping downwards towards the first opening 126.

Thus, advantageously, the build-up of potentially flammable, corrosive, or otherwise hazardous liquid and/or particulate matter within the pumping chamber 171 tends to be reduced or eliminated. Furthermore, the impedance of, for example, the rotors 104, 108, by the liquid and/or particulate matter tends to be reduced or eliminated. Thus, pumping efficiency of the pump tends to be improved.

Advantageously, the spatial separation of the stator 102 and the headplates 112, 114 by the O-rings 144, 164 and the spacers 146, 166 (i.e. the presence of the gaps 148, 168 between the stator 102 and the headplates 112, 114) tends to reduce heat transfer between the stator 102 and the headplates 112, 114. Thus, in implementations where the temperature of the stator 102 is relatively high, the temperature of the headplate may nevertheless remain relatively low. For example, in some implementations, the temperature of the stator 102 may be about 200° C. while the temperature of the headplates 112, 114 may be about 100° C. This advantageously tends to improve operation of the vacuum pump 100.

In this embodiment, the second stator part 118 further comprises a channel 182 formed within the second wall 152. The channel 182 extends between a first opening 184 and a second opening 186.

In this embodiment, the first opening 184 is formed in an internal surface 188 of the second wall 152, the internal surface 188 being opposite to the external surface 158. The first opening 184 is located at the exhaust side 176 of the chamber 171.

In this embodiment, the second opening 186 is formed in the internal surface 188 of the second wall 152. The second opening 186 is located at the suction side 172 of the chamber 171.

In this embodiment, a pressure relief valve 190 is disposed within the channel 182, between the first and second openings 184, 186. In this embodiment, the pressure relief valve 190 is configured to prevent the flow of fluid through the channel 182 if the pressure differential across the pressure relief valve 190 is less than a predefined threshold value (e.g. 1 bar). Also, the pressure relief valve 190 is configured to allow the flow of fluid through the channel 182 if the pressure differential across the pressure relief valve 190 is greater than or equal to the predefined threshold value.

Thus, in this embodiment, in operation, if the pressure differential across the pressure relief valve 190, i.e. the pressure differential between the exhaust side 176 of the chamber 171 and the suction side 172 of the chamber 171, is greater than or equal to the predefined threshold value, the pressure relief valve 190 opens to allow pumped fluid to flow through the channel 182, from the exhaust side 176 of the chamber 171 to the suction side 172 of the chamber 171. This advantageously tends to reduce the pressure differential between the exhaust side 176 and the suction side 172. In other words, the pressure differential across the rotors 104, 108 is reduced. Thus, the risk of damage to the rotors 104, 108 tends to be reduced.

Advantageously, the channel 182 being fluidly connected between the exhaust side 176 and the suction side 172 tends to provide for more rapid reduction in the pressure differential between the exhaust side 176 and the suction side 172. Nevertheless, in some embodiments, the channel 182 may be fluidly coupled between the pumping chamber 171 (e.g. the exhaust side 176 of the chamber 171) and an external environment of the pump 100.

The pressure relief valve 190 is located or housed within the stator 102, in particular in the second wall 152 of the stator 102 in this embodiment. The pressure relief valve 190 may be regarded as integral with or integrated within the stator 102. In use, the temperature of the stator 102 tends to be relatively high compared to, say, the temperature of the headplates 112, 114. For example, in some implementations, the temperature of the stator 102 may be about 200° C. while the temperature of the headplates 112, 114 may be about 100° C. The relatively high temperature of the stator 102 tends to reduce or eliminate condensation of pumped fluid within the channel 182. This advantageously tends to reduce or eliminate condensate impeding operation of the pressure relief valve 190.

In this embodiment, the pressure relief valve 190 is located in a housing that is removable from the stator via an aperture in the side of the second end wall 152. This advantageously tends to facilitate inspection, maintenance, servicing, and/or repair of the pressure relief valve 190.

Advantageously, by locating the pressure relief valve 190 in the upper part of the stator, i.e. in the top end wall, any particulate matter or fluid that does enter the channel 182 will tend to drop out of the channel 182 (i.e. the pressure relief valve duct) rather than accumulate.

In some embodiments, the channel 182 is a multifurcating (e.g. bifurcating channel) have multiple first openings (or inlets) and/or multiple second openings (or outlets). In some embodiments, multiple pressure relief valves may be located in the channel.

In the above embodiments, the vacuum pump is a vertically oriented Roots-type vacuum pump. However, in other embodiments, the vacuum pump is a different type of vacuum pump. The vacuum pump may have any number of stages, pumping chambers, rotors and rotor shafts, for example.

In the above embodiments, the stator is formed of two parts that attach together to form the stator. However, in other embodiments, the stator is formed of a different number of parts, such as only a single part, or of more than two parts that attach together to form the stator.

In the above embodiments, the inlet is formed in the second stator part. However, in other embodiments, the inlet is located in a different stator part, such as the first stator part. In some embodiments, the inlet is formed through multiple different stator parts.

In the above embodiments, the two headplates are spaced apart from the stator. However, in other embodiments, one or more of the headplates is not spaced apart from the stator. For example, one or more of the headplates may be in contact with the stator or may be integral with the stator.

In the above embodiments, the second stator part comprises the channel in which the pressure relief valve is located. However, in other embodiments, the channel and the pressure relief valve located therein may be disposed in a different part of the stator such as the first stator part, for example, the first wall.

In the above embodiments, the outlet is formed in the first stator part. However, in other embodiments, the outlet is located in a different stator part, such as the second stator part. In some embodiments, the outlet is formed through multiple different stator parts.

In the above embodiments, the internal surface of the first wall of the first stator is contiguous with the opening of the outlet channel. In other words, the lowermost surface or point of the opening is substantially flush with or below the internal surface of the first wall. However, in other embodiments, the internal surface of the first wall of the first stator is not contiguous with the opening of the outlet channel. The lowermost surface or point of the opening may be located at a level above that of the internal surface of the first wall.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A stator for a vertically oriented vacuum pump, comprising:

a plurality of walls defining therebetween at least a part of a pumping chamber;

a channel formed within one or more of the walls of the plurality of walls, the channel comprising a first opening at a first end of the channel and a second opening at a second end of the channel, the first opening being an opening in an internal surface of the one or more of the walls, the first opening being in fluid communication with the pumping chamber; and a pressure relief valve disposed within the channel;

wherein the plurality of walls comprises:

a top end wall; and one or more sidewalls extending from the top end wall, wherein the top end wall and the one or more sidewalls define an internal cavity; and an inlet channel formed through a sidewall of the one or more sidewalls for allowing a fluid to flow from an outside of the stator into the internal cavity;

wherein:

the channel is formed in the top end wall;

the top end wall and the one or more sidewalls are a single, unitary item;

the first opening is formed in an internal surface of the top end wall and the second opening is formed in the internal surface of the top end wall;

the first opening is located at an exhaust side of the pumping chamber;

the second opening is located at a suction side of the pumping chamber; and the top end wall comprises one or more through bores, each of the one or more through bores being for receiving a respective rotor shaft.

2. The stator for a vacuum pump according to claim 1, wherein the pressure relief valve is located in a housing that is removable from the stator via an aperture in an external surface of the stator.

3. The stator for a vacuum pump according to claim 1, wherein the end wall comprises an external surface, the external surface of the end wall comprising one or more recesses.

4. The stator for a vacuum pump according to claim 3, wherein the one or more recesses are selected from the group of recess consisting of a loop-shaped groove for receiving an O-ring and a recess configured to receive a thermally insulative spacer.

5. The stator for a vacuum pump according to claim 3, further comprising:

an O-ring disposed within the one or more recesses; and a headplate for supporting one or more rotor shafts, the headplate being disposed facing the external surface of the end wall and against the O-ring such that the headplate is spaced apart from the external surface of the end wall.

6. The stator for a vacuum pump according to claim 3, further comprising:

at least one thermally insulative spacer disposed within the one or more recesses; and a headplate for supporting one or more rotor shafts, the headplate being disposed facing the external surface of the end wall and against the at least one spacer such that the headplate is spaced apart from the external surface of the end wall.

7. A vertically-oriented vacuum pump comprising:

the stator according to claim 1;

one or more rotor shafts extending vertically through the pumping chamber of the stator; and one or more rotors, each rotor being mounted on a respective one of the rotor shafts.

* * * * *